United States Patent [19]

Steele

[11] Patent Number: 4,653,580

[45] Date of Patent: Mar. 31, 1987

[54] FLOW TANK HEAT EXCHANGER

[76] Inventor: Luther R. Steele, 4404 Briarhaven Rd., Fort Worth, Tex. 76109

[21] Appl. No.: 726,820

[22] Filed: Apr. 25, 1985

[51] Int. Cl.[4] ..... F28D 1/02

[52] U.S. Cl. ..... 165/153; 165/76; 165/149; 29/157.3 B

[58] Field of Search ..... 165/150, 151, 152, 153, 165/149

[56] References Cited

U.S. PATENT DOCUMENTS 3,254,708 6/1966 Oddy ..... 165/153
3,920,069 11/1975 Mosier ..... 165/152 X
3,993,125 11/1976 Rhodes ..... 165/153
4,041,594 8/1977 Chartet ..... 165/153 X
4,311,193 1/1982 Verhaeghe et al. ..... 165/153 X

*Primary Examiner*—Albert W. Davis, Jr.
*Assistant Examiner*—Richard R. Cole

[57] ABSTRACT

An extrusion tube and fin heat exchanger includes two end plates and two tank caps. A plurality of parallel extrusion tubes is disposed between the plates and through the tank caps. A plurality of fins formed of aluminum sheet, folded back and forth, is disposed between the tubes and about the extrusions. A tank cover is sealed over the tank cap at each end. The parts are assembled by a vibration method.

1 Claim, 8 Drawing Figures

FIG. 1
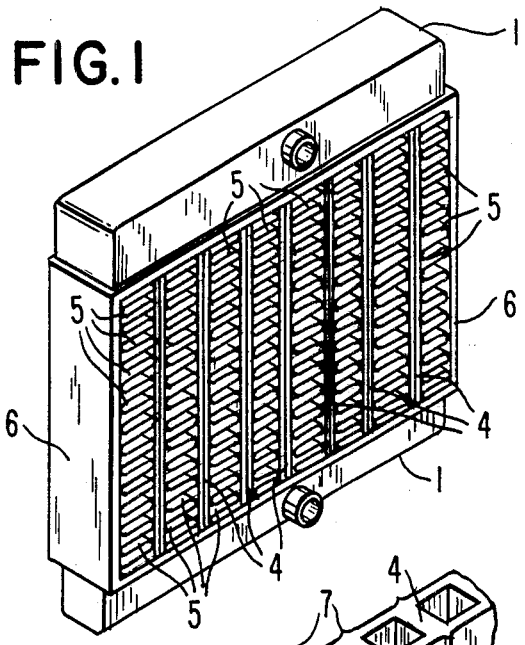
FIG. 2
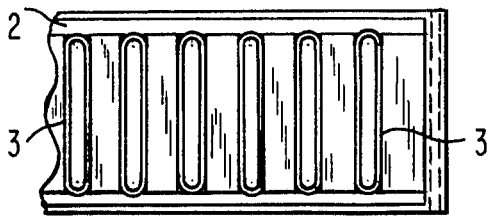
FIG. 3
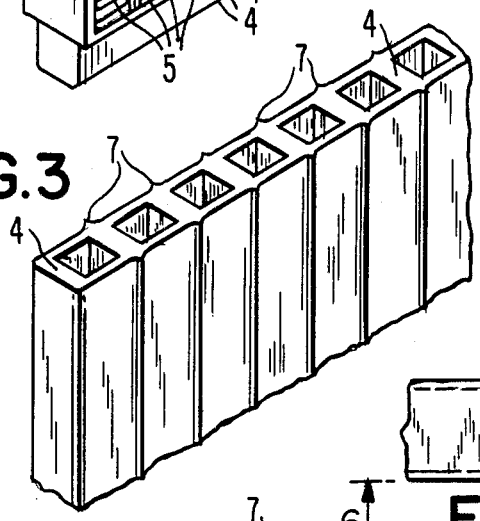
FIG. 4
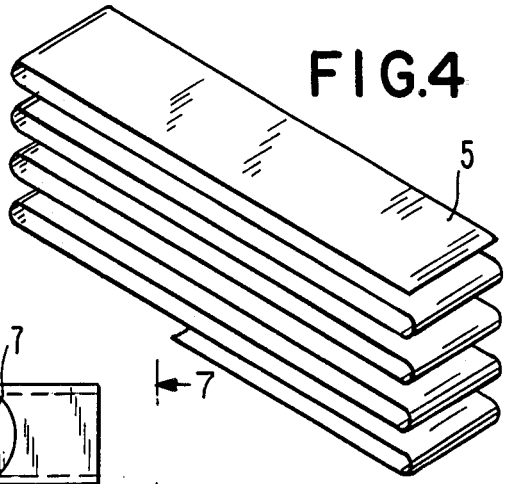
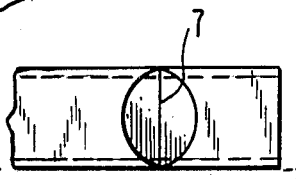
FIG. 5
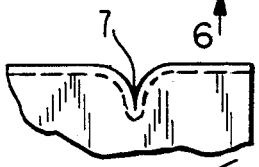
FIG. 6
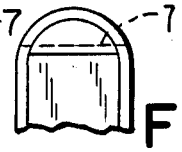
FIG. 7
FIG. 8
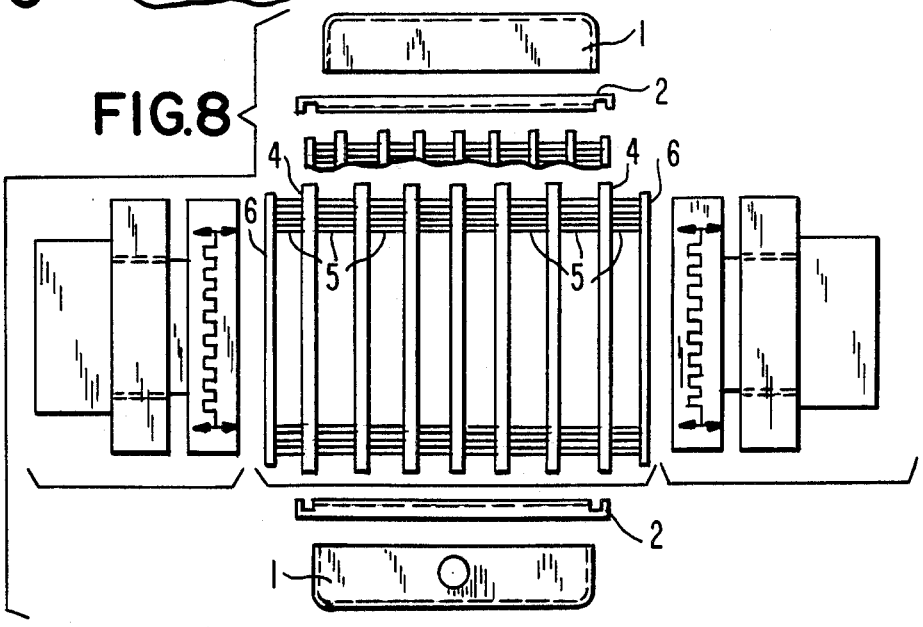

FLOW TANK HEAT EXCHANGER

BACKGROUND OF THE INVENTION

1. Field of the Invention

This invention relates to a heat exchanger, more particularly, to an automobile air conditioner cooler with fins and tubes.

2. Description of Prior Art

In general, fin and tube heater exchangers are of three types.

A. Plate fin evaporator coil heat exchanger provides coils with a series of stampings, between which are compressed with folded fin stock and are vacuum soldered.

B. Serpentine evaporator coil heat exchanger provides a continuous flat tube with turns going back and forth. Fin stock is compressed between each flat tube length and vacuum soldered in places.

C. Tube and fin heat exchanger provides a series of tubing with fin stock around each tubing.

Most of these types of heat exchangers are either labor-intensive because of many parts needed to be soldered or too much pressure loss due to the coil design. Accordingly, the primary object of this invention is to provide a low pressure drop coil design and easy assembling process, thus eliminating labor intensive soldering.

SUMMARY OF THE INVENTION

The present invention is applicable to any circumstance where either heating or cooling is desired. The invention will be described with reference to automobile installation as an example.

A heat exchanger according to the present invention comprises a plurality of parallel tubes connected at each end to a tank cap which is pressed over two end plates. A tank cover is welded onto the tank cap forming a tank at each end. Each tank provides an inlet or outlet means for passing refrigerant directly through the parallel tubes, thus reducing refrigerant pressure drop. Fin stock is made from about 0.005" thick aluminum sheet, folded back and forth and placed between tubes. A special designed tube with extrusion on the tubes extending outwardly provides extra surface area for dissipating heat for the automobile air conditioner. A unique process, dieless vibratory assembly process, is employed for assembling the parts of the heat exchanger to a unit by vibration such that the fins are not damaged during assembly.

BRIEF DESCRIPTION OF THE DRAWING

FIG. 1 is a perspective view of the embodiment of the present invention;

FIG. 2 is a fragmentary top plan view of the self-locking tank cap;

FIG. 3 is a fragmentary perspective view of the extrusion tube embodiment of the invention;

FIG. 4 is a fragmentary perspective view of the aluminum fin stock;

FIG. 5 is a fragmentary elevated end view enlarged to show fin stock contact surface for heat transfer;

FIG. 6 is a bottom plan view taken along view line 6—6 of FIG. 5.

FIG. 7 is a side elevational view taken along view line 7—7 of FIG. 5, and FIG. 8 is a front elevational view of the vibratory assembly forming dieless process used in the embodiment of the present invention.

DETAILED DESCRIPTION

Referring to the drawing, FIG. 1 shows a perspective view of the assembled heat exchanger. A tank cover 1 is welded on a tank cap 2, to form a sealed tank at each end. The tank cap has rows of flanged openings 3, for connecting to a series of extrusion tubes 4. Each tank cap has flanges to press-fit two end plates 6. Thus, the parallel extrusion tubes 4 are in communication with the tanks. Between the tubes there is disposed a plurality of fins 5 made of aluminum sheet folded back and forth. Projected extrusion 7 on each tube extending outwardly for providing extra surface area so as to increase heat transfer efficiency.

In assembling, as shown in FIG. 8, all parts are set in a fixture in assembling order, and by applying vibration with controlled frequencies, the parts are vibrated to fit each other without damaging the thin fins thus the process is economical as well as efficient. First, the end plates, extrusion tubes, and fin between tubes and around extrusions are arranged in a fixture (not shown). Apply vibration at 88 cycles per second of frequency, for about 18 seconds. Press tank caps over extrusion tubes and end plates. Seal tank cap to extrusion tubes and last seal tank caps.

While various changes may be made in the detail construction, it is understood that such changes will be within the spirit and scope of the present invention, as is defined by the appended claims.

What I now claim is:

1. A heat exchanger, comprising, in combination, an inverted tank vessel and a horizontal tank cap welded therebeneath and together forming an upper tank, a second tank vessel and a horizontal tank cap welded thereabove and together forming a lower tank, a plurality of parallel, spaced-apart, extruded tube partitions between said tank caps, each said tube partition having a row vertical openings therethrough for communication between said tanks, a plurality of flanged openings through both of said tank caps receiving, press-fit, opposite ends of said tube partitions, a vertical end plate between one end of both said tank caps and another vertical plate between an opposite end of said tank caps, opposite ends of said end plates being press-fit in recesses in said tank caps, and a heat-dissipating fin between each one of said tube partitions and between each said end-plate and an endmost of said plurality of tube partitions, each said fin comprising a flat metal sheet bent into serpentine-shape having semi-circular portions between flat horizontal portions; and heat transfer means between said tube partitions and said fins comprising sideward and longitudinally extending projections of said tube partitions being fitted into correspondingly shaped indentations bent in said semi-circular portions of said fins.

* * * * *